US012209296B2

(12) United States Patent
Park et al.

(10) Patent No.: US 12,209,296 B2
(45) Date of Patent: Jan. 28, 2025

(54) ALUMINIUM ALLOY FOR DIE CASTING, METHOD FOR MANUFACTURING SAME, AND DIE CASTING METHOD

(71) Applicant: Samsung Electronics Co., Ltd., Suwon-si (KR)

(72) Inventors: Sungtae Park, Suwon-si (KR); Sangjun Park, Suwon-si (KR); Won Ju, Suwon-si (KR); Jungsoo Lim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 930 days.

(21) Appl. No.: 17/265,962

(22) PCT Filed: Aug. 23, 2019

(86) PCT No.: PCT/KR2019/010776
§ 371 (c)(1),
(2) Date: Feb. 4, 2021

(87) PCT Pub. No.: WO2020/040602
PCT Pub. Date: Feb. 27, 2020

(65) Prior Publication Data

US 2021/0292874 A1 Sep. 23, 2021

(30) Foreign Application Priority Data

Aug. 24, 2018 (KR) ..... 10-2018-0099452

(51) Int. Cl.
*C22C 21/02* (2006.01)
*B22D 21/00* (2006.01)
(Continued)

(52) U.S. Cl.
CPC ..... *C22C 21/02* (2013.01); *B22D 21/007* (2013.01); *C22C 1/03* (2013.01); *D06F 37/20* (2013.01)

(58) Field of Classification Search
CPC ..... C22C 21/02
See application file for complete search history.

(56) References Cited

U.S. PATENT DOCUMENTS 8,852,365 B2 10/2014 Sankaran et al.
2005/0100472 A1 5/2005 Yamada et al.
(Continued)

FOREIGN PATENT DOCUMENTS

CN 103374673 A 10/2013
CN 103469029 12/2013
(Continued)

OTHER PUBLICATIONS

Espacenet machine translation of CN-107858565-A retrieved on Oct. 23, 2023 (Year: 2018).*
(Continued)

*Primary Examiner* — Keith D. Hendricks
*Assistant Examiner* — Joshua S Carpenter
(74) *Attorney, Agent, or Firm* — STAAS & HALSEY LLP

(57) ABSTRACT

Provided is an aluminum alloy for die casting. The aluminum alloy includes: 3-10 wt % silicon (Si); 0.1-2.0 wt % magnesium (Mg); 0.01-1.3 wt % iron (Fe); 0.01-2.0 wt % zinc (Zn); 0.01-1.5 wt % copper (Cu); 0.01-0.5 wt % manganese (Mn); 0.01-0.5 wt % chrome (Cr); 0.01~2.0 wt % lanthanum (La); 0.01~2.0 wt % cerium (Ce); 0.01~2.0 wt % strontium (Sr); rest aluminum (Al); and unavoidable impurities. The aluminum alloy is improved in not only corrosion-resistance but also physical properties.

14 Claims, 15 Drawing Sheets

(51) Int. Cl.
*C22C 1/03* (2006.01)
*D06F 37/20* (2006.01)

(56) References Cited

U.S. PATENT DOCUMENTS

| | | | | |
|---|---|---|---|---|
| 2010/0170996 | A1 | 7/2010 | Sankaran et al. | |
| 2010/0288401 | A1 | 11/2010 | Hennings et al. | |
| 2012/0000578 | A1 * | 1/2012 | Wang | C22C 21/04 164/47 |

FOREIGN PATENT DOCUMENTS

| | | | | |
|---|---|---|---|---|
| CN | 104878256 | A | 9/2015 | |
| CN | 105296818 | A * | 2/2016 | C22C 1/02 |
| CN | 105441737 | | 3/2016 | |
| CN | 107858565 | | 3/2018 | |
| CN | 107858565 | A * | 3/2018 | |
| CN | 108300910 | A | 7/2018 | |
| DE | 10 2006 039 684 | A1 | 2/2008 | |
| EP | 3 301 198 | A1 | 4/2018 | |
| JP | 58-90365 | | 5/1983 | |
| KR | 20130032981 | A * | 4/2010 | B22D 21/04 |
| KR | 10-1606525 | | 3/2016 | |
| KR | 10-1641170 | | 7/2016 | |
| KR | 10-1691001 | | 12/2016 | |
| KR | 10-2018-0035390 | | 4/2018 | |

OTHER PUBLICATIONS

Espacenet machine translation of KR20130032981A retrieved on Dec. 9, 2023 (Year: 2013).*
Espacenet machine translation of CN 105296818 A retrieved on Jun. 6, 2024 (Year: 2016).*
European Search Report for European Patent Application No. 19851357.4 dated Jul. 14, 2021.
International Search Report dated Dec. 20, 2019 in International Patent Application No. PCT/KR2019/010776.
Office Action dated Mar. 8, 2023 in Korean PatentApplication No. 10-2018-0099452

* cited by examiner

ALUMINIUM ALLOY FOR DIE CASTING, METHOD FOR MANUFACTURING SAME, AND DIE CASTING METHOD

CROSS-REFERENCE TO RELATED APPLICATIONS

This application is a U.S. National Stage Application, which claims the benefit under 35 U.S.C. § 371 of PCT International Patent Application No. PCT/KR2019/010776, filed Aug. 23, 2019 which claims the foreign priority benefit under 35 U.S.C. § 119 of Korean Patent Application No. 10-2018-0099452, filed Aug. 24, 2018, the contents of which are incorporated herein by reference.

TECHNICAL FIELD

The disclosure relates to an aluminum alloy for die casting, a manufacturing method thereof, and a die casting method.

BACKGROUND ART

Aluminum (Al) is alloyed with additive elements such as copper (Cu), silicon (Si), manganese (Mn), magnesium (Mg), zinc (Zn), etc. to create various kinds of alloys, and varies in characteristics depending on the kinds of alloy. The aluminum alloy may be assorted into an alloy for casting and an alloy for work according to manufacturing methods. The casting method is classified into sand casting, mold casting, high-pressure casting, die casting, and special casting. The aluminum for work may be treated to have characteristics suitable for secondary work such as roll, extrusion, forging, press, etc. The aluminum alloy for casting includes a basic Al—Si alloy, an Al—Cu alloy for improvement in mechanical properties, and an Al—Mg alloy for improvement in high corrosion-resistance characteristics, but is mostly the Al—Si alloy.

The alloy for die casting is a kind of alloy for casting, but different in alloy composition from a general alloy for casting because of a different casting method from those of sand casting, mold casting, low-pressure casting, etc. The alloy for die casting is required to have characteristics of molten metal flow and low stickiness of molten metal to a die, and thus an Al—Si alloy and an Al—Si—Cu alloy excellent in such characteristics are generally used. Aluminum is alloyed to achieve various strength and corrosion-resistance characteristics, and has been developed as alternative materials for brass and copper parts.

As the aluminum alloys for the die casting, which are widely used these days, there have been used Al—Mg alloys such as ALDC 5, ALDC 6, etc. and Al—Si alloys such as ALDC 3, ALDC 10, and ALDC 12, etc. which are excellent in casting. However, such aluminum alloys for die casting have problems that mechanical properties are degraded because of pores formed therein by air inflow during die casting, and corrosion-resistance characteristics are low. A conventional alloy for die casting employs a lot of scraps and is thus increased in corrosion as compared with pure aluminum. In particular, ADC 12 has high content of Fe, Cu and Si and is therefore vulnerable to corrosion under environments where it is highly likely to be exposed to water.

Korean Patent Publication No. 10-2018-0035390 has disclosed an aluminum alloy for die casting, which contains lanthanum (La) and strontium (Sr), and a method for manufacturing the same. The disclosed alloy for die casting contains 3~10 wt % Mg. Like this, the alloy for casting, which contains a lot of magnesium having high corrosion-resistance, decreases productivity because molten metal sticks to the surface of the die and the life of the mold is shortened. Further, a conventional alloy for die casting is decreased in strength because magnesium for improving the corrosion resistance is alloyed to form a Mg2Si phase. Therefore, there is required an aluminum alloy for die casting, which maintains high corrosion-resistance and has good strength.

DISCLOSURE

Technical Problem

The disclosure is to provide an aluminum alloy for die casting, a manufacturing method thereof, and a die casting method, in which the aluminum alloy for casting is improved in not only corrosion-resistance but also mechanical properties such as fatigue strength, impact strength, and tensile strength.

Technical Solution

According to an embodiment, there is provided an aluminum alloy for die casting. The aluminum alloy includes: 3-10 wt % silicon (Si); 0.1-2.0 wt % magnesium (Mg); 0.01-1.3 wt % iron (Fe); 0.01-2.0 wt % zinc (Zn); 0.01-1.5 wt % copper (Cu); 0.01-0.5 wt % manganese (Mn); 0.01-0.5 wt % chrome (Cr); 0.01~2.0 wt % lanthanum (La); 0.01~2.0 wt % cerium (Ce); 0.01~2.0 wt % strontium (Sr); rest aluminum (Al); and unavoidable impurities.

The aluminum alloy may include 0.8~1.2 wt % magnesium (Mg).

The aluminum alloy may include 0.1~1.0 wt % lanthanum (La)

The aluminum alloy may include 0.1~1.0 wt % cerium (Ce)

The aluminum alloy may include 0.1~1.0 wt % strontium (Sr).

The aluminum alloy may have a liquidus temperature of 580-590° C., and a solidus temperature of 475-485° C.

According to an embodiment, there is provided a method of manufacturing an aluminum alloy for die casting. The method includes: manufacturing a master alloy including lanthanum (La), and strontium (Sr) and cerium (Ce); melting 3-10 wt % silicon (Si), 0.1-2.0 wt % magnesium (Mg), 0.01-1.3 wt % iron (Fe), 0.01-2.0 wt % zinc (Zn), 0.01-1.5 wt % copper (Cu), 0.01-0.5 wt % manganese (Mn), 0.01-0.5 wt % chrome (Cr), and rest aluminum (Al) in a crucible; and adding the master alloy to the crucible so that the aluminum alloy for die casting includes 0.01-2.0 wt % lanthanum (La), 0.01-2.0 wt % strontium (Sr), and 0.01-2.0 wt % cerium (Ce) at percentages by weight with respect to its total weight.

The method may further include adding flux to the crucible.

The master alloy may include an Al—Sr—La—Ce quaternary master alloy.

According to an embodiment, there is provided a die casting method. The method includes: putting and melting an ingot of an aluminum alloy for die casting, which includes 3-10 wt % silicon (Si), 0.1-2.0 wt % magnesium (Mg), 0.01-1.3 wt % iron (Fe), 0.01-2.0 wt % zinc (Zn), 0.01-1.5 wt % copper (Cu), 0.01-0.5 wt % manganese (Mn), 0.01-0.5 wt % chrome (Cr), 0.01~2.0 wt % lanthanum (La), 0.01~2.0 wt % cerium (Ce), 0.01~2.0 wt % strontium (Sr), rest aluminum (Al); and unavoidable impurities, in a melting furnace; pouring the molten aluminum alloy from the melting furnace to a sleeve, and pushing the molten aluminum alloy into a mold by a plunger at predetermined speed and pressure.

The molten aluminum alloy may have a temperature of 660-710° C.

The predetermined speed may be kept in 0.10-0.25 m/s and then switched over to 1.95-2.5 m/s.

The switching may be performed at a position of 355-375 mm.

The predetermined pressure may include 93-110 kgf.

According to an embodiment, there is provided an aluminum flange shaft for a washing machine, which is manufactured with the aluminum alloy for die casting as described above.

Advantageous Effects

The aluminum alloy for die casting according to the disclosure is improved in corrosion-resistance, thereby extending an applicable range of parts, and obviating a need for post-processing (e.g. electro deposition coating, chemical coating) of die casting parts.

Further, the aluminum alloy for die casting according to the disclosure is improved in physical properties, thereby lightening weight thereof even while maintaining strength.

Further, the aluminum alloy for die casting according to the disclosure is improved in flowability of molten metal, thereby having an effect on decreasing trap pores.

BEST MODE

Figure 1:
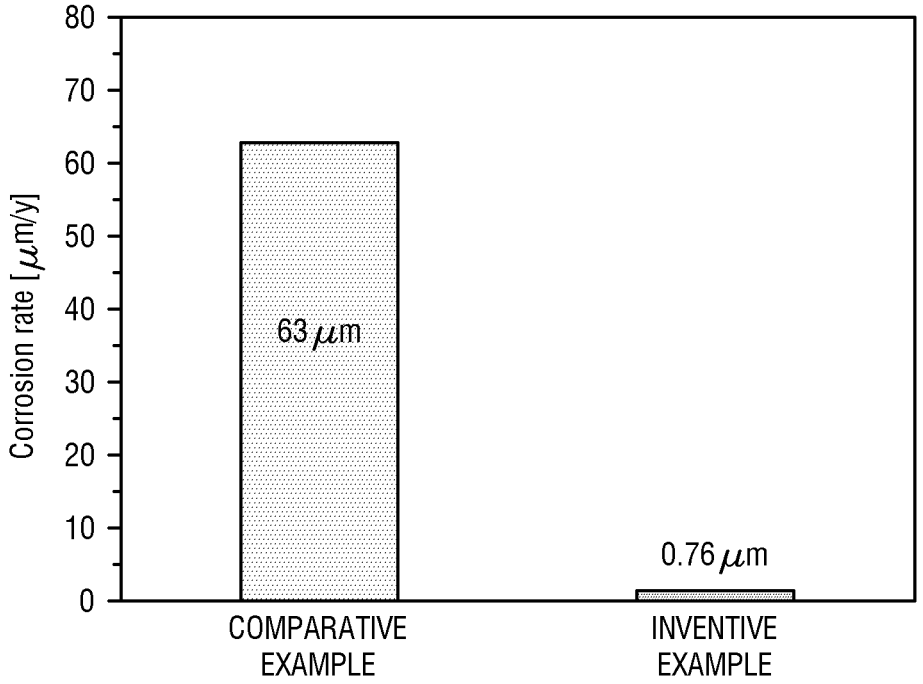
FIG. 1 shows polarization test results of aluminum alloy samples.

Below, the disclosure will be described in detail with reference to the accompanying drawings. In the following descriptions, details about publicly known functions or configurations may be omitted if it is determined that the details are likely to unnecessarily obscure the gist of the disclosure. In addition, the following embodiments may be modified in many different forms, and scope of technical concept according to the disclosure is not limited to the following embodiments. Rather, these embodiments are provided so that this disclosure will be thorough and complete, and will fully convey concept of the disclosure to a person having an ordinary skill in the art.

Further, 'including' a certain element is intended not to exclude other elements but to additionally include other elements unless otherwise mentioned.

According to the disclosure, an aluminum alloy for die casting consists of 0.1-2.0 wt % magnesium (Mg), 3-10 wt % silicon (Si), 0.01-1.3 wt % iron (Fe), 0.01-2.0 wt % zinc (Zn), 0.01-0.5 wt % manganese (Mn), 0.01-1.5 wt % copper (Cu), 0.01-0.5 wt % chrome (Cr), 0.01-2.0 wt % lanthanum (La), 0.01-2.0 wt % cerium (Ce) and 0.01-2.0 wt % strontium (Sr), rest aluminum (Al) and unavoidable impurities.

The unavoidable impurities contained in the alloy may be infinitesimal, for example, less than 0.01 wt %. Such incidental impurities may include B, Sn, Pb, Ni, Cd, Ag, Zr, Ca, Mo, or other transition metal elements, but are not limited to these elements. The incidental impurities may be variously contained according to casting.

The aluminum alloy for die casting according to the disclosure may contain 0.1 to 2.0 wt %, preferably 0.8 to 1.2 wt % magnesium (Mg). Magnesium not only improves corrosion-resistance but is also lighter than silicon (Si) to thereby have an advantage in manufacturing a lightweight product. When magnesium content is less than 0.01 wt %, corrosion-resistance and lightening effects are not expected. When magnesium content is more than 2.0 wt %, magnesium combines with silicon and increases production of Mg2Si to thereby reduce tensile strength, and increased stickiness of molten metal decreases flowability to thereby reduce workability.

In particular, a magnesium alloy for die casting according to the disclosure has technical meaning in that it is a composition capable of achieving a highly strengthened product without reducing the corrosion-resistance and the workability. Therefore, the magnesium alloy for die casting according to the disclosure may be applied to parts of home appliances required to have both the strength and the high corrosion-resistance. The magnesium alloy for die casting according to the disclosure may for example be used for a drum flange shaft of a washing machine which repetitively gets a shock and is exposed to water or moisture.

Further, the aluminum alloy for die casting according to the disclosure contains 3 to 10 wt % silicon (Si) with respect to the total weight of the whole alloy. Silicon improves the flowability of the aluminum alloy to thereby enhance formability, lowers a coagulation shrinkage rate to thereby decrease shrinkage, and serves to improve hardness. When silicon content is less than 3 wt %, it is less effective. When silicon content is more than 10 wt %, a thermal expansion coefficient and elongation are lowered and marks may be formed on a surface.

Further, the aluminum alloy for die casting according to the disclosure contains 0.01 to 1.3 wt % iron (Fe) with respect to the total weight of the whole alloy. Iron reduces adhesion to a mold for die casting to thereby enhance castability and serves to reduce erosion of the mold. When iron content is less than 0.01 wt % with respect to the total weight of the whole alloy, it is difficult to release a casting. On the other hand, when iron content is more than 1.3 wt %, iron combines with aluminum and silicon and produces a weak precipitate, thereby reducing the corrosion-resistance of the aluminum alloy.

The aluminum alloy for die casting according to the disclosure contains 0.01 to 2.0 wt % zinc (Zn) with respect to the total weight of the whole alloy. Zinc has effects on improving strength and castability in the alloy. When zinc content is less than 0.01 wt %) with respect to the total weight of the whole alloy, it is impossible to have the effects on improving the foregoing mechanical properties, i.e. the strength and the castability. On the other hand, when zinc content is more than 2.0 wt %, the density of the alloy is decreased to thereby cause a crack.

The aluminum alloy for die casting according to the disclosure contains 0.01 to 0.5 wt % manganese (Mn) with respect to the total weight of the whole alloy. Manganese educes a Mn-A16 phase from the alloy and serves to improve the mechanical properties of the alloy by a solid solution strengthening phenomenon and distribution of a fine precipitate. When manganese content is less than 0.01 wt % with respect to with respect to the total weight of the whole alloy, it is impossible to have the effects on improving the foregoing mechanical properties. On the other hand, when manganese content is more than 0.5 wt %, adhesion causes workability to be reduced like magnesium.

The aluminum alloy for die casting according to the disclosure contains 0.01 to 1.5 wt % copper (Cu) with respect to the total weight of the whole alloy. Copper serves to improve strength and hardness in the alloy. When copper content is less than 0.01 wt % with respect to the total alloy weight, it is impossible to have the effects on improving the mechanical properties. On the other hand, when copper content is more than 1.5 wt %, it is possible to reduce the corrosion-resistance and the elongation.

The aluminum alloy for die casting according to the disclosure contains 0.01 to 0.5 wt % chrome (Cr) with respect to the total weight of the whole alloy. Chrome added to the aluminum alloy serves to retard grain growth and prevent stress corrosion and a crack. When chrome content is less than 0.01 wt %, the effects on preventing the stress corrosion and the crack are not expected. When chrome content is more than 0.5 wt %, corrosion-resistance is reduced as chromic acid is extruded.

The aluminum alloy for die casting according to the disclosure contains 0.01 to 2.0 wt %, preferably, 0.01 to 0.5 wt % lanthanum (La) as a rare earth element with respect to the total weight of the whole alloy. Lanthanum added to the aluminum alloy improves the flowability of the aluminum alloy to thereby enhance formability, and improves the molten alloy having characteristics of sticking to the mold, and has an effect on improving the corrosion-resistance. Specifically, lanthanum forms a compound between Cu, Fe or the like alloy element and metal to thereby have an effect on stabilizing a microcrystalline phase in an aluminum matrix. Meanwhile, when lanthanum content is less than 0.01 wt %, the effects on improving the flowability and the corrosion-resistance are not expected. When lanthanum content is more than 2.0 wt %, pores are caused on the surface of the alloy.

Further, the aluminum alloy for die casting according to the disclosure contains 0.01 to 2.0 wt %, preferably, 0.01 to 0.5 wt % cerium (Ce) as a rare earth element with respect to the total weight of the whole alloy. Cerium added to the aluminum alloy improves the corrosion-resistance of the aluminum alloy. Specifically, cerium forms a compound between Cu, Fe or the like alloy element and metal to thereby have an effect on stabilizing a microcrystalline phase in the aluminum matrix. Meanwhile, when cerium content is less than 0.01 wt %, the effect on improving the corrosion-resistance is not expected. When cerium content is more than 2.0 wt %, pores based on oxidation are caused on the surface of the alloy.

The aluminum alloy for die casting according to the disclosure contains 0.01 to 2.0 wt %, preferably 0.05 to 1.0 wt %, more preferably 0.1 to 0.5 wt % strontium (Sr) with respect to the total weight of the whole alloy. Strontium decreases pores caused by air inflow during die casting, thereby having an effect on improving the strength of the alloy. When strontium content is less than 0.01 wt %, the effects on improving the mechanical properties are not expected. On the other hand, when strontium content is more than 2.0 wt %, the pores are decreased in distribution but increased in size.

The aluminum alloy for die casting according to the disclosure contains rest aluminum (Al) and unavoidable impurities when the content of magnesium, silicon, iron, zinc, copper, manganese, chrome, lanthanum, cerium, and strontium is set as described above with reference to the total weight.

Each of aluminum, silicon, iron, copper and chrome may have 99% purity.

As compared with a conventional aluminum alloy for die casting, the aluminum alloy for die casting according to the disclosure is effectively improved in the corrosion-resistance even though less magnesium (Mg) content is added for improving the strength. In other words, the aluminum alloy for die casting according to the disclosure additionally contains chrome for retarding the grain growth while decreasing magnesium for reducing the strength by forming the Mg2Si phase, thereby preventing the stress corrosion and the crack. Further, the aluminum alloy for die casting according to the disclosure does not stick to the mold to thereby enhance workability and lengthen the life of the mold, and is decreased in pores formed during the die casting to thereby improve mechanical properties such as strength, withstand capability, allowable impact value, etc. Therefore, it is possible to solve problems of increasing manufacturing time and damaging manufacturing tools due to chip curling caused when a conventional aluminum alloy is manufactured.

Physical Property Test of Aluminum Alloy for Die Casting

To test the physical properties, an aluminum alloy for die casting was manufactured with composition of magnesium, silicon, iron, zinc, copper, manganese, chrome, lanthanum, cerium, strontium and aluminum as shown in the following Table 1, and a conventional aluminum alloy for die casting was prepared for comparison.

TABLE 1

| Alloy (wt %) | Mg | Si | Fe | Zn | Cu | Mn | Cr | La | Ce | Sr | Al |
|---|---|---|---|---|---|---|---|---|---|---|---|
| Comparative example | 6.0 | 6.5 | 0.8 | 0.8 | 1.0 | 0.1 | — | 0.3 | — | 0.15 | the rest |
| Inventive example | 1.0 | 6.5 | 0.65 | 1.0 | 0.75 | 0.25 | 0.25 | 1.0 | 1.0 | 1.0 | the rest |

The aluminum alloy of the inventive example and the conventional aluminum alloy of the comparative example, manufactured with the composition based on Table 1, were melted and kept at 600 to 700° C., and injected into the mold, extruded and cooled by publicly known methods, thereby respectively preparing test pieces. FIGS. 1 to 4 show polarization test, half-immersion test, Prohesion cycle test, and sodium hydroxide solution evaluation results with regard to each of the inventive and comparative examples. As shown in FIG. 1, as a result of the polarization test with 5% sodium chloride (NaCl) solution for 30 minutes, the corrosion speed of the inventive example was decreased from 63 μm/year to 0.76 μm/year as compared with that of the comparative example.

Figure 2:
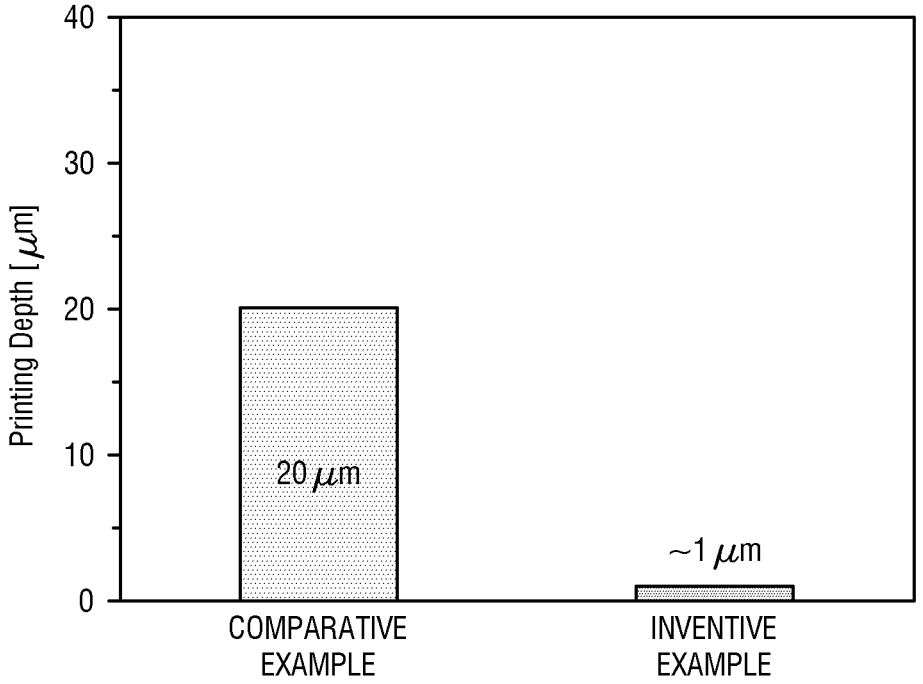
FIG. 2 shows half-immersion test results of an aluminum alloy sample.

As shown in FIG. 2, as a result of the half-immersion test with 5% sodium chloride (NaCl) solution at 50□ for 96 hours, pitting depth was decreased from 20 μm to 1 μm.

Figure 3:
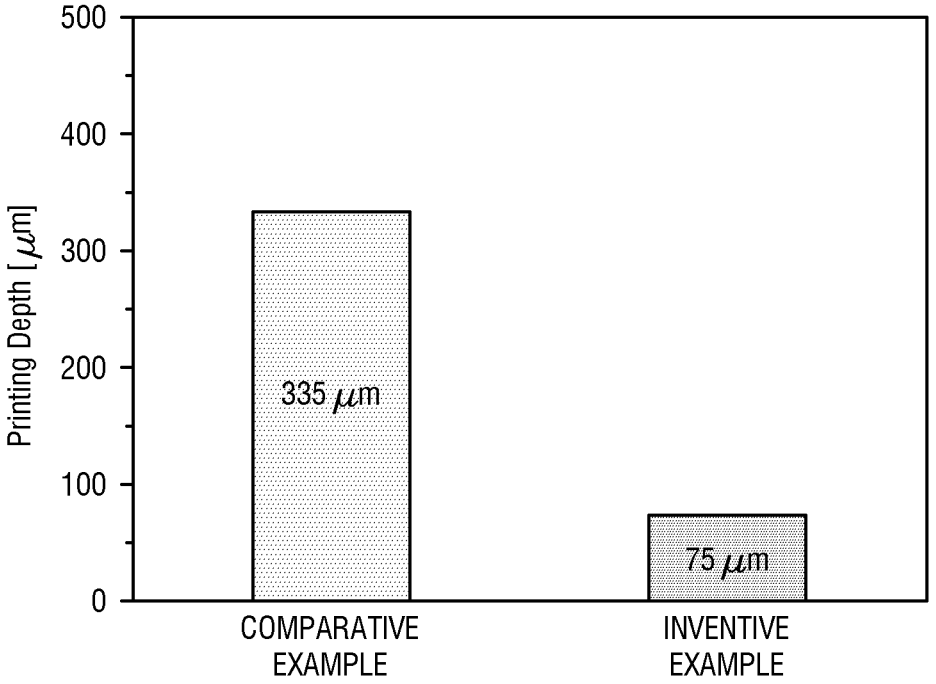
FIG. 3 shows a Prohesion test result of an aluminum alloy samples.

As shown in FIG. 3, as a result of the Prohesion cycle test with 0.05% sodium chloride (NaCl) solution and 0.35% ammonium sulfate($(NH_4)_2SO_4$) solution for 1000 hours, the pitting depth of the inventive example was decreased from 335 μm to 75 μm as compared with that of the comparative example.

Figure 4:
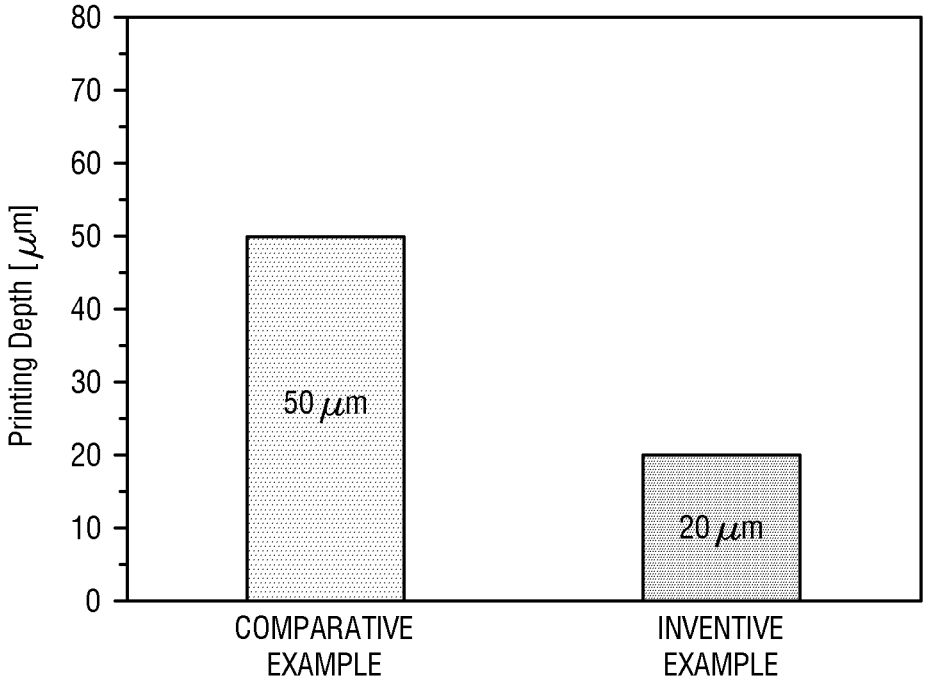
FIG. 4 shows corrosion test results of aluminum alloy samples by sodium hydroxide.

As shown in FIG. 4, as a result of 1000-cycle corrosion test with sodium hydroxide (pH10-11) solution, the pitting depth of the inventive example was decreased from 50 μm to 20 μm as compared with that of the comparative example.

As described above, the aluminum alloy according to the disclosure (inventive example) was decreased in corrosion speed and also largely decreased in pitting corrosion depth as compared with those of the conventional aluminum alloy (comparative example).

Figure 5:
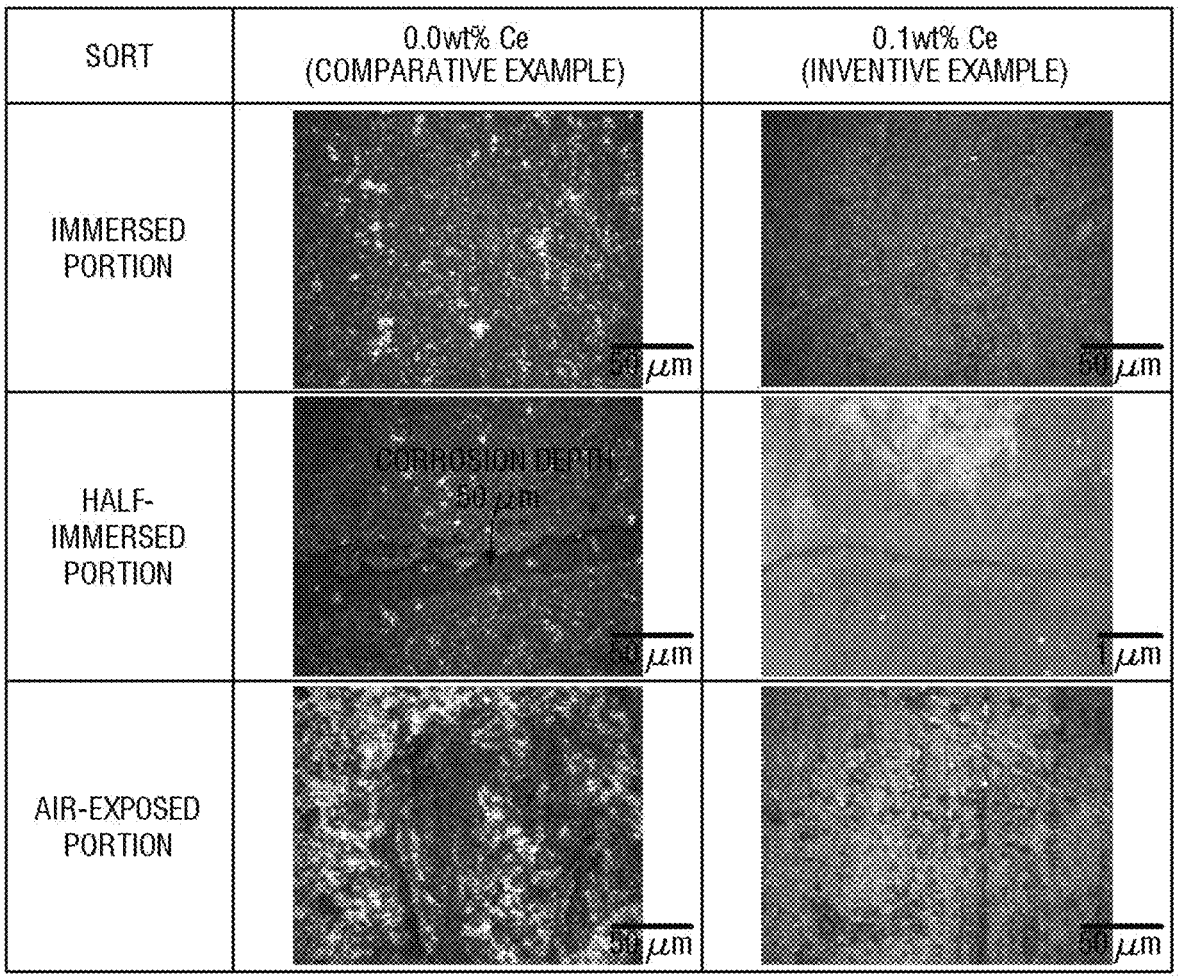
FIG. 5 shows corrosion characteristics of aluminum alloy samples according to cerium content.

FIG. 5 shows corrosion characteristics of the aluminum alloy for die casting, measured according to addition of cerium by the half-immersion test. The corrosion measurement was carried out with regard to an aluminum alloy for die casting of an inventive sample added with 0.1 wt % cerium and an aluminum alloy for die casting of a comparative sample with no cerium.

As shown in FIG. 5, the comparative sample with no cerium showed a corrosion depth of 20 μm in a half-immersed portion, and has progressed intergranular corrosion caused by a defective surface. On the other hand, the inventive sample with 0.1 wt % cerium showed no corrosion in a half-immersed portion, and did not show any progressed corrosion even in an immersed portion and an air-exposed portion.

Mechanical Property Test of Aluminum Alloy for Die Casting

The yield strength ($N/mm^2$), the tensile strength ($N/mm^2$), and the elongation (%) were measured with regard to inventive samples 1-7 with magnesium content(0.1 wt %-2.0 wt %) of the aluminum alloy according to the disclosure shown in the Table 1, comparative samples 1-3 of the aluminum alloys (3 wt %, 4 wt % and 5 wt % Mg) disclosed in Korean Patent Publication No. 10-2018-0035390, and a comparative sample 4 of the conventional ADC12 alloy.

The comparative sample 4 of the conventional ADC12 alloy has the composition ratios (wt %) as shown in the following Table 2.

TABLE 2

| Composition | Si | Fe | Cu | Mn | Mg | Sr | La | Ce | Zn |
|---|---|---|---|---|---|---|---|---|---|
| ADC12 | 9.63-12.0 | ~1.3 | ~0.6 | ~0.3 | 0.4-0.6 | — | — | — | ~0.5 |

The yield strength ($N/mm^2$), the tensile strength ($N/mm^2$), and the elongation (%) of the inventive and comparative samples were as shown in the following Table 3.

TABLE 3

| Properties | yield strength [$N/mm^2$] | tensile strength [$N/mm^2$] | elongation [%} |
|---|---|---|---|
| Inventive sample 1 (0.1 wt % Mg) | 95 | 251 | 20.1 |
| Inventive sample 2 (0.3 wt % Mg) | 111 | 261 | 18.4 |
| Inventive sample 3 (0.5 wt % Mg) | 132 | 270 | 15.0 |
| Inventive sample 4 (0.8 wt % Mg) | 157 | 280 | 10.5 |
| Inventive sample 5 (1.0 wt % Mg) | 170 | 285 | 8.0 |
| Inventive sample 6 (1.2 wt % Mg) | 188 | 290 | 7.5 |
| Inventive sample 7 (2.0 wt % Mg) | 187 | 298 | 6.1 |
| Comparative sample 1 (3.0 wt % Mg) | 210 | 245 | 1.7 |
| Comparative sample 2 (4.0 wt % Mg) | 220 | 235 | 0.2 |
| Comparative sample 3 (5.0 wt % Mg) | 153 | 153 | 0.0 |
| Comparative sample 4 (ADC12) | 150 | 285 | 6.5 |

Figure 6:
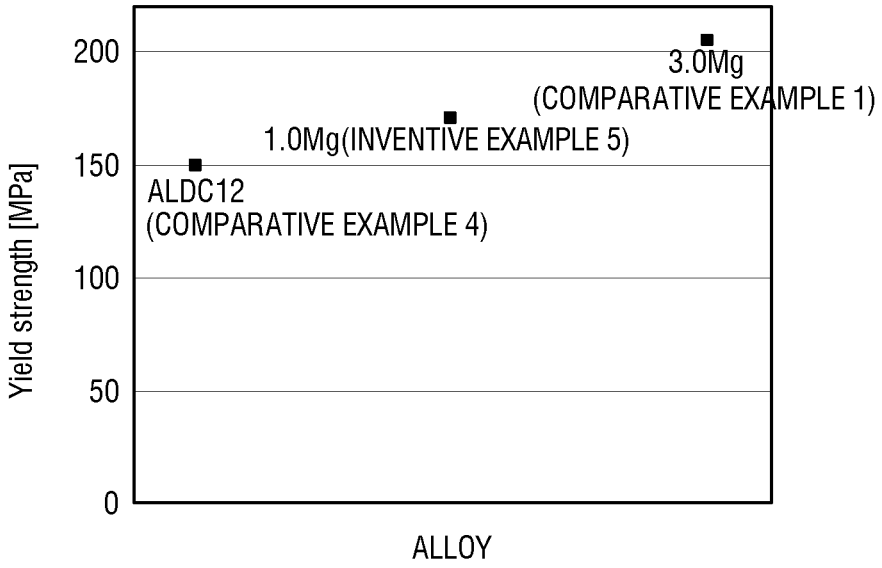
FIG. 6 shows yield strength of aluminum alloy samples.
Figure 7:
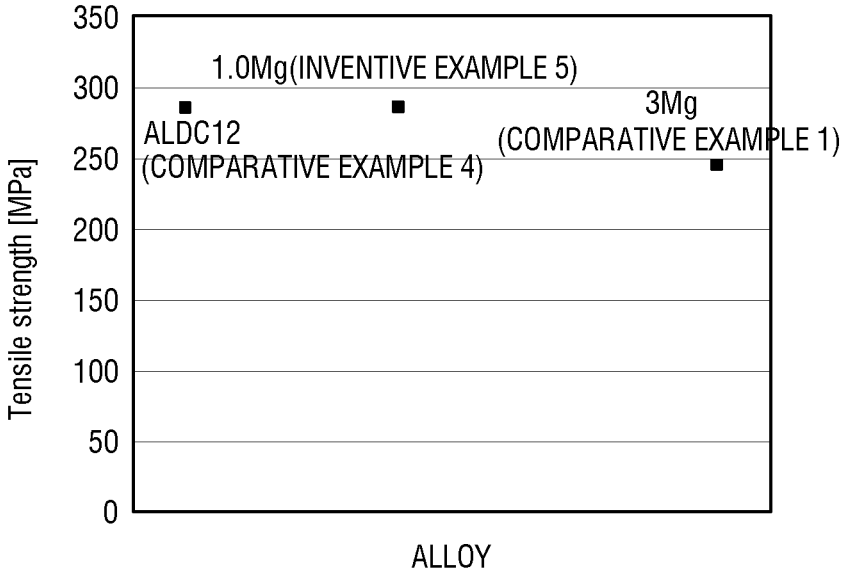
FIG. 7 shows tensile strength of aluminum alloy samples.
Figure 8:
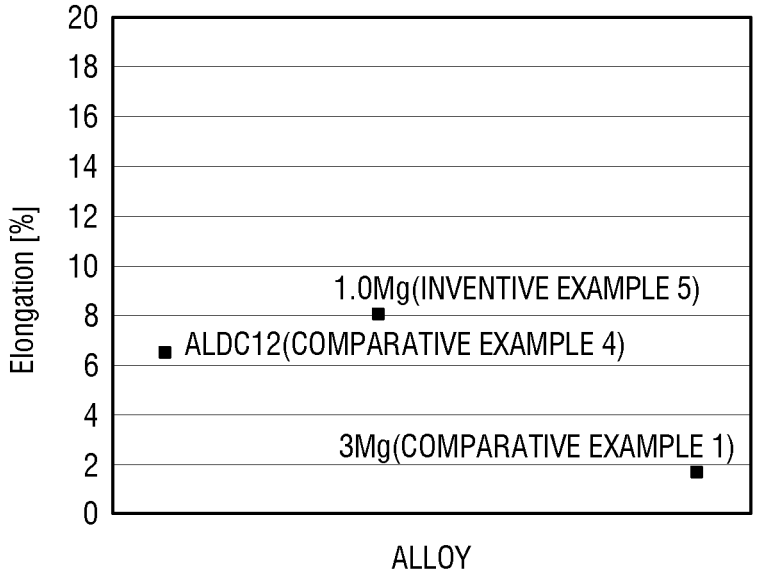
FIG. 8 shows elongation of aluminum alloy samples.

FIGS. 6 to 8 are graphs respectively showing the yield strength (N/mm2), the tensile strength (N/mm2), and the elongation (%) with regard to the inventive sample 5 (1 wt % Mg) of the aluminum alloy according to the disclosure, the comparative sample 1 (3 wt % Mg) and the comparative sample 4 (ADC12). As shown therein, the inventive sample 5 of 1 wt % Mg was increased in the yield strength by 13%, equivalent in the tensile strength, and was increased in the elongation by 23% as compared with the comparative sample 4 (ADC12). Further, the inventive sample 5 of 1 wt % Mg was decreased in the yield strength by 20%, increased in the tensile strength by 16%, and increased in the elongation by 470%.

Figure 9:
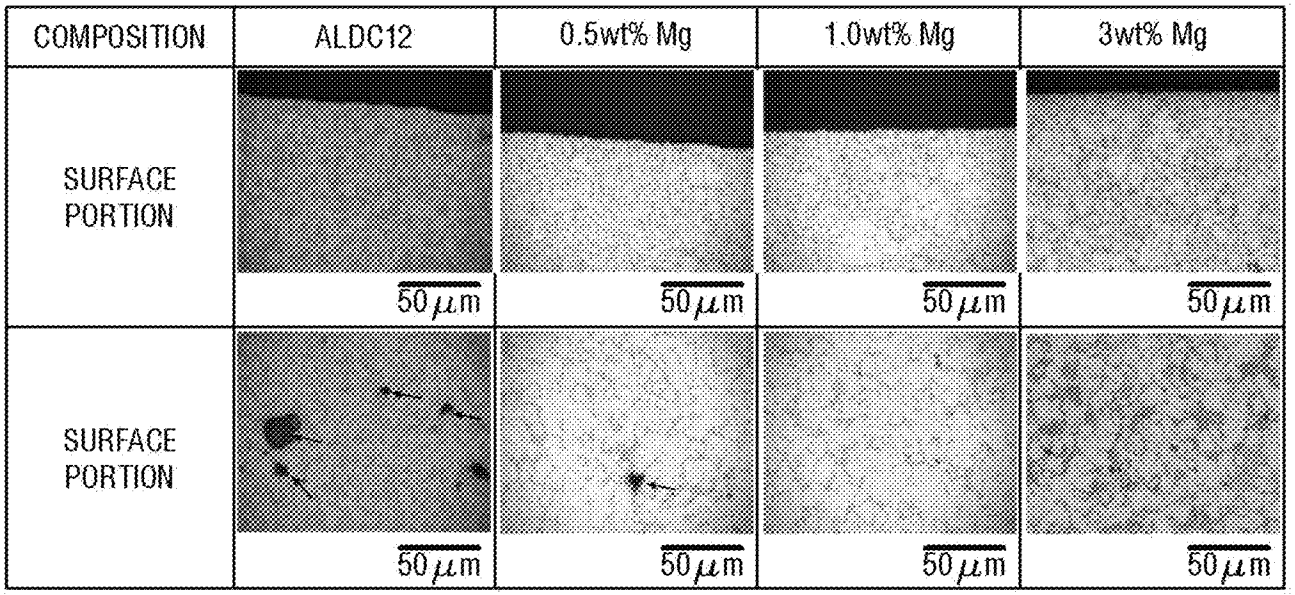
FIG. 9 shows corrosion in surface and center portions of aluminum alloy samples.

FIG. 9 shows surface and core portions of the inventive sample 5 (1 wt % Mg) according to the disclosure, the comparative sample 1(3 wt % Mg) and the comparative sample 4 (ADC12). As shown therein, the inventive sample 5 (1 wt % Mg) according to the disclosure showed a low pore distribution in the core and surface portions and a primary phase smaller than 10 μm. On the other hand, the comparative sample 4 (ADC12) showed that the primary phase was developed on the surface portion and grown to 30 μm having a spherical shape in the core portion, and many pores of 10-50 μm were distributed. Further, the comparative sample 1 (3 wt % Mg) showed that fine pores are distributed on the surface portion, and the primary phase was grown up to 50 μm in the core portion. Thus, it will be appreciated that the comparative sample 1 (3 wt % Mg) is decreased in corrosion-resistance due to the development of Mg2Si when alloyed.

Figure 10:
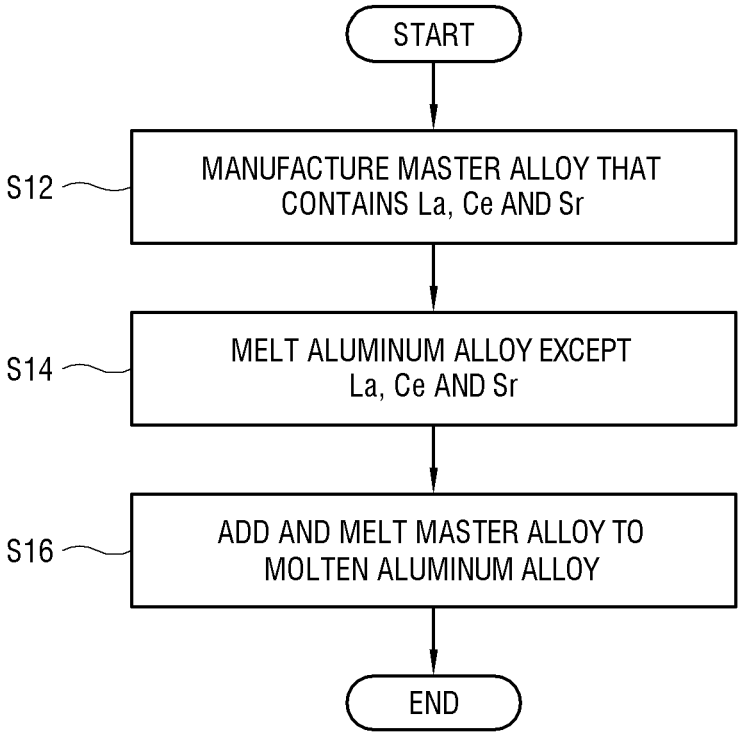
FIG. 10 is a flowchart showing a method of manufacturing an aluminum alloy for die casting according to the disclosure.

FIG. 10 is a flowchart showing a method of manufacturing an aluminum alloy for die casting according to the disclosure.

First, a master alloy with lanthanum (La), cerium (Ce) and strontium (Sr) is manufactured (512). Specifically, lanthanum (La), cerium (Ce) and strontium (Sr) based on composition are added to aluminum (Al), and melted together at 600 to 700° C. to thereby manufacture an Al—La—Ce—Sr quaternary master alloy. In this case, the master alloy based on a three-element system of Al—Ce—La except strontium (Sr) may be manufactured.

Next, in the aluminum alloy according to the disclosure, elements based on composition except lanthanum (La), cerium (Ce) and strontium (Sr) are put into a crucible and then melted at 600 to 700□ (S14). Specifically, 3-10 wt % silicon (Si), 0.1-2.0 wt % magnesium (Mg), 0.01-1.3 wt % iron (Fe), 0.01-2.0 wt % zinc (Zn), 0.01-1.5 wt % copper (Cu), 0.01-0.5 wt % manganese (Mn), 0.01-0.5 wt % chrome (Cr), and rest aluminum (Al) with respect to the total weight of the aluminum alloy for die casting are put into the crucible and then melted.

In this case, the crucible may include a graphite crucible. Meanwhile, flux is added after the melting is completed, so that a process of forming an oxidation protection layer on the surface of the molten metal can be further performed.

Next, the manufactured master alloy based on the composition is added to molten metal and melted together (S16) Specifically, the master alloy is put into the crucible so that the aluminum alloy for die casting can contain 0.01-2.0 wt % lanthanum (La), 0.01-2.0 wt % strontium (Sr) and 0.01-2.0 wt % cerium (Ce) at percentages by weight with respect to its total weight. In this case, heating may be performed at 600 to 700□ for 30 to 60 minutes after the master alloy is added to the molten metal, thereby completely dissolving the master alloy.

Like this, the master alloy may be manufactured to contain lanthanum (La), cerium (Ce) and strontium (Sr), so that the alloy can be more stably manufactured without a loss of elements.

Meanwhile, it has been described above that the master alloy is manufactured to contain lanthanum (La), cerium (Ce) and strontium (Sr), and then the aluminum alloy except lanthanum (La), cerium (Ce) and strontium (Sr) is melted. However, without being limited to this description, the aluminum alloy except lanthanum (La), cerium (Ce) and strontium (Sr) may be melted and then the master alloy may be manufactured to contain lanthanum (La), cerium (Ce) and strontium (Sr), or these processes may be individually performed at the same time.

The foregoing aluminum alloy for die casting according to the disclosure has advantages of facilitating casting with high flowability, having less stickiness to a surface of a mold, and being improved in mechanical properties and corrosion-resistance.

Figure 11:
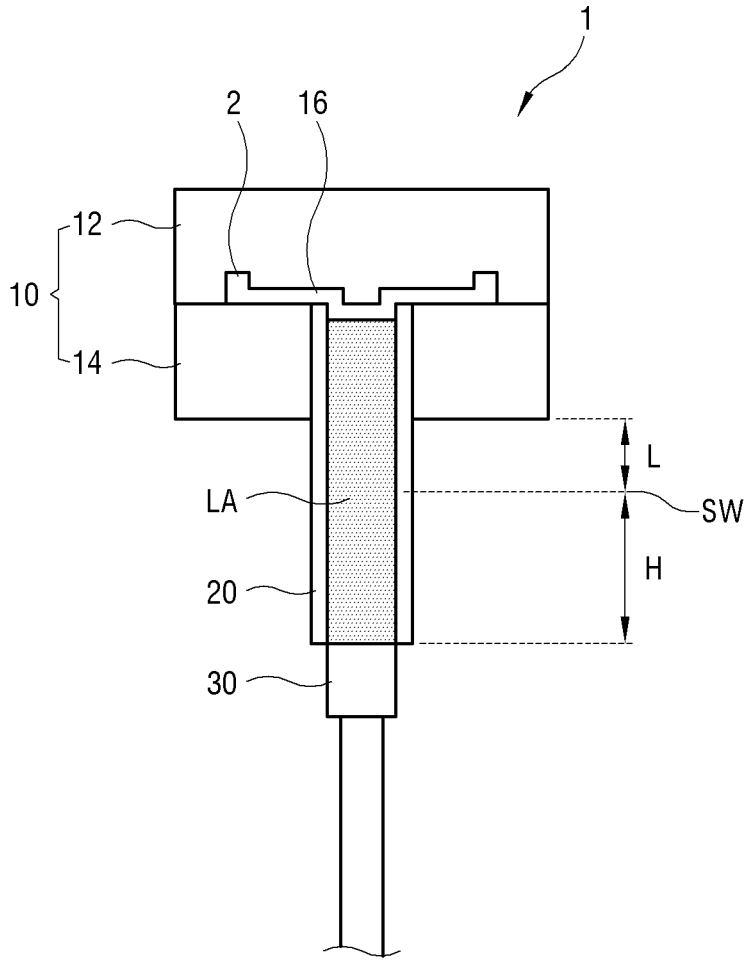
FIGS. 11 and 12 are schematic views of a die casting apparatus according to the disclosure.
Figure 12:
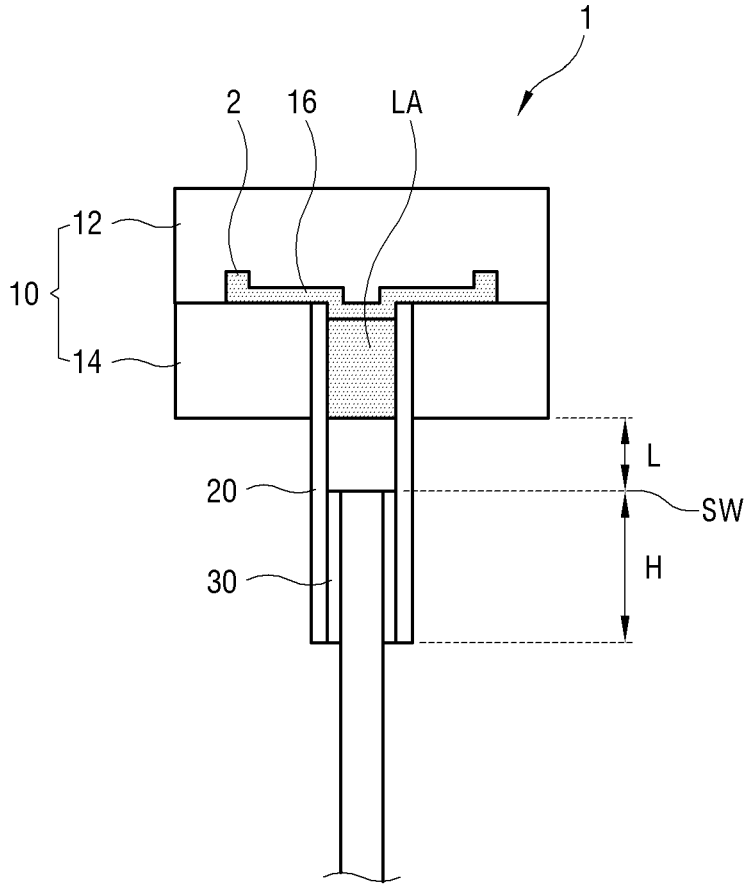

FIGS. 11 and 12 are schematic views of a die casting apparatus 1 according to the disclosure. The die casting apparatus 1 includes a mold 10 divided into an upper mold 12 and a lower mold 14, a sleeve 20 accommodating molten metal LA to be injected into the mold 10, and a plunger 30 pushing the molten metal from the sleeve 20 to the mold 10. Between the upper mold 12 and the lower mold 14, a space 16 which corresponds to a shape of a thing to be casted, i.e., into which molten metal is injected, is provided.

During the die casting, the plunger 30 pushes the molten metal (LA) at predetermined speed and pressure within the sleeve 20. In this case, the plunger 30 moves at low speed in an initial stage and moves at high speed at a switching position SW.

Figure 13:
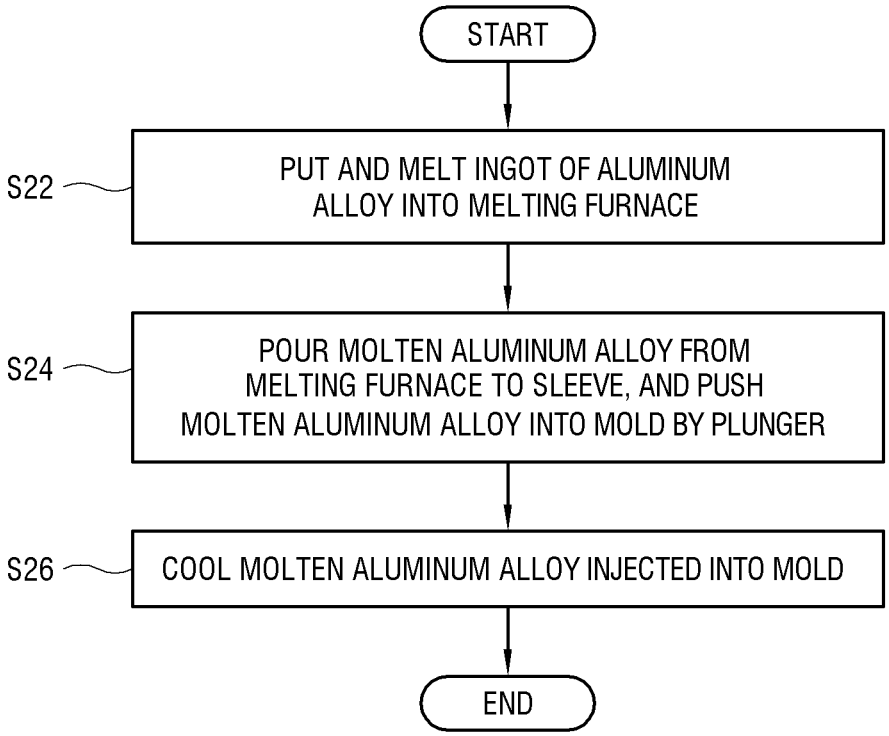
FIG. 13 is a flowchart showing a die casting method according to the disclosure.

FIG. 13 is a flowchart showing a die casting method according to the disclosure.

First, an ingot of the aluminum alloy for die casting according to the disclosure, specifically, the aluminum alloy for die casting that contains 3-10 wt % silicon (Si), 0.1-2.0 wt % magnesium (Mg), 0.01-1.3 wt % iron (Fe), 0.01-2.0 wt % zinc (Zn), 0.01-1.5 wt % copper (Cu), 0.01-0.5 wt % manganese (Mn), 0.01-0.5 wt % chrome (Cr), 0.01~2.0 wt % lanthanum (La), 0.01~2.0 wt % cerium (Ce), 0.01~2.0 wt % strontium (Sr), rest aluminum (Al); and unavoidable impurities is put into and melted in a melting furnace (not shown) (S22). The aluminum alloy for die casting according to the disclosure has a liquidus temperature of 585.8 [° C.], and a solidus temperature of 479.8 [° C.]. The temperature of molten metal is set to 660-710° C. by taking the liquidus temperature (585.8° C.) and solidus temperature (479.8° C.) of the aluminum alloy into account. Because the liquidus temperature according to the disclosure is higher than the liquidus temperature of 577.9° C. the conventional aluminum alloy has, the temperature of the molten metal was set to be higher than the temperature of the conventional molten metal.

Next, molten aluminum alloy (LA) in the melting furnace is poured in the sleeve 20, and then pushed into the mold 10 at predetermined speed and by predetermined pressure by the plunger 30 (S24).

Figure 14:
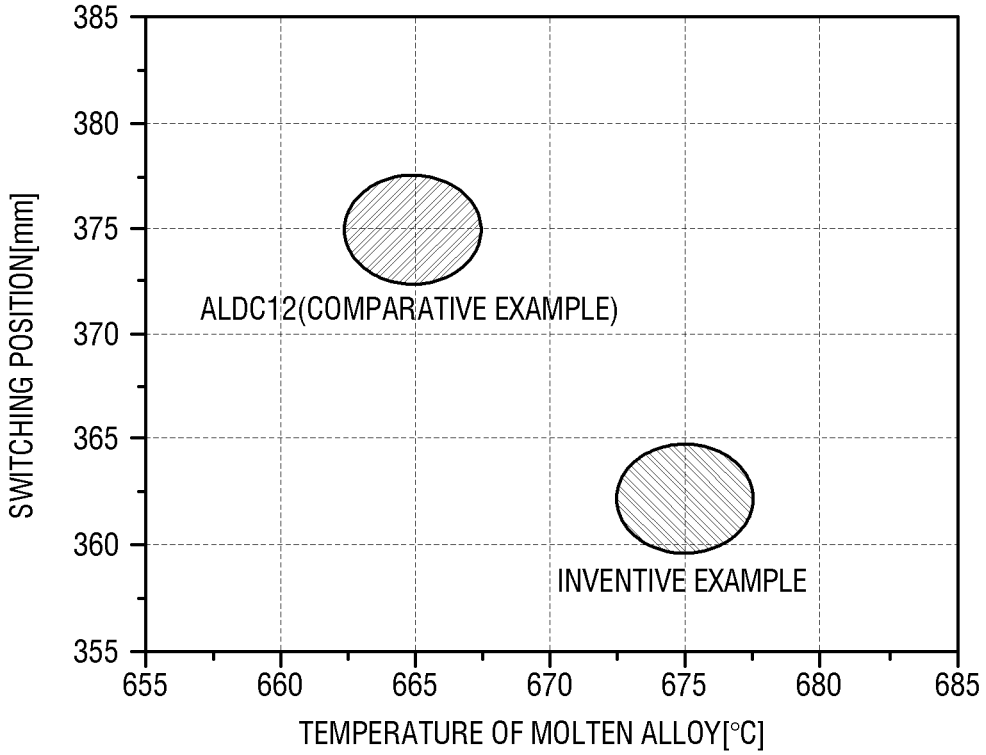
FIG. 14 shows a relationship between a switching position of a plunger and a temperature of molten aluminum alloy samples.
Figure 15:
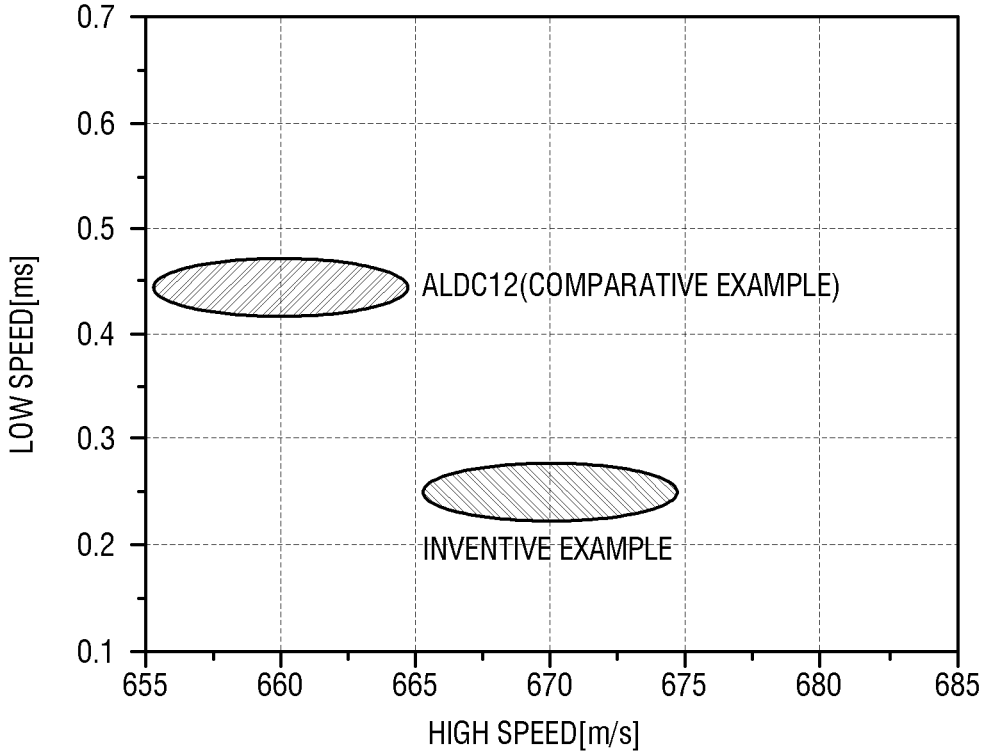
FIG. 15 shows a relationship between a high-speed section and a low-speed section of a plunger during die casting of aluminum alloy samples.

FIG. 14 shows a relationship between the switching position of the plunger 30 and the temperature of the molten metal, and FIG. 15 shows a relationship between a high-speed section and a low-speed section of the plunger. As shown therein, the temperature of the molten aluminum alloy according to the disclosure is higher than that of the conventional aluminum alloy, and it is thus possible to decrease the switching position.

The speed switching position SW of the plunger 30 is 355~375 mm, which is shorter than the switching position (377.5 mm) of when the conventional aluminum alloy is used. Such decrease in the switching position means that the high-speed section is increased and the low-speed section is decreased.

Further, as shown in FIG. 15, the die casting of the aluminum alloy according to the disclosure has a low-speed section of 0.10-0.25 m/s and a high-speed section of 1.95-2.5 m/s. On the other hand, the diecasting of the conventional aluminum alloy (ALDC12) according to the comparative example has a low-speed of 0.20 m/s and a high-speed section of 1.8-2.0 m/s. Such increase in the high speed improves the flowability of the molten metal, and such decrease in the low speed reduces decreasing trap pores.

Last, the molten metal injected into the mold 10 is cooled to thereby make a product (S26).

Although a few embodiments of the disclosure have been illustrated and described, the disclosure is not limited to the foregoing specific embodiments, various modifications can be made by a person having ordinary skill in the art without departing from the gist of the disclosure defined in claims, and such modified embodiments should not be individually understood from technical concept or prospect of the disclosure.

The invention claimed is:

1. A die-castable aluminum alloy consisting of:
3-10 wt % silicon (Si);
0.8-1.2 wt % magnesium (Mg);
0.01-1.3 wt % iron (Fe);
0.01-2.0 wt % zinc (Zn);
0.01-1.5 wt % copper (Cu);
0.01-0.5 wt % manganese (Mn);
0.01-0.5 wt % chromium (Cr);
0.01-2.0 wt % lanthanum (La);
0.01-2.0 wt % cerium (Ce);
0.01-2.0 wt % strontium (Sr);
rest aluminum (Al); and
less than 0.01 wt % of unavoidable impurities.

2. The die-castable aluminum alloy according to claim 1, wherein the wt % of the lanthanum (La) is 0.1-1.0 wt %.

3. The die-castable aluminum alloy according to claim 1, wherein the wt % of the cerium (Ce) is 0.1-1.0 wt %.

4. The die-castable aluminum alloy according to claim 1, wherein the wt % of the strontium (Sr) is 0.1-1.0 wt %.

5. The die-castable aluminum alloy according to claim 1, wherein a liquidus temperature of the die-castable aluminum alloy is 580-590° C., and a solidus temperature of the die-castable aluminum alloy is 475-485° C.

6. A method of manufacturing a die-castable aluminum alloy, the method comprising:

manufacturing a master alloy comprising lanthanum (La), strontium (Sr), and cerium (Ce);

melting silicon (Si), magnesium (Mg), iron (Fe), zinc (Zn), copper (Cu), manganese (Mn), chromium (Cr), and aluminum (Al) in a crucible; and adding the master alloy to the crucible so that the die-castable aluminum alloy consists of 3-10 wt % silicon (Si), 0.8-1.2 wt % magnesium (Mg), 0.01-1.3 wt % iron (Fe), 0.01-2.0 wt % zinc (Zn), 0.01-1.5 wt % copper (Cu), 0.01-0.5 wt % manganese (Mn), 0.01-0.5 wt % chromium (Cr), 0.01-2.0 wt % lanthanum (La), 0.01-2.0 wt % strontium (Sr), 0.01-2.0 wt % cerium (Ce), rest aluminum (Al), and less than 0.01 wt % of unavoidable impurities at percentages by weight with respect to its total weight.

7. The method according to claim 6, further comprising adding a flux to the crucible.

8. The method according to claim 6, wherein the master alloy comprises an Al—Sr—La—Ce quaternary master alloy.

9. A die casting method comprising:

melting an ingot of a die-castable aluminum alloy, which consists of 3-10 wt % silicon (Si), 0.8-1.2 wt % magnesium (Mg), 0.01-1.3 wt % iron (Fe), 0.01-2.0 wt % zinc (Zn), 0.01-1.5 wt % copper (Cu), 0.01-0.5 wt % manganese (Mn), 0.01-0.5 wt % chromium (Cr), 0.01-2.0 wt % lanthanum (La), 0.01-2.0 wt % cerium (Ce), 0.01-2.0 wt % strontium (Sr), rest aluminum (Al); and less than 0.01 wt % of unavoidable impurities, in a melting furnace; and pouring the melted die-castable aluminum alloy from the melting furnace to a sleeve; and pushing the melted die-castable aluminum alloy into a mold by a plunger at a predetermined speed and a predetermined pressure.

10. The die casting method according to claim 9, wherein the melted die-castable aluminum alloy has a temperature of 660-710° C.

11. The die casting method according to claim 9, wherein the predetermined speed is kept at 0.10-0.25 m/s and then switched to 1.95-2.5 m/s.

12. The die casting method according to claim 9, wherein the predetermined pressure comprises 93-110 kgf.

13. The die casting method according to claim 11, wherein the predetermined speed is switched at a position of 355-375 mm.

14. An aluminum flange shaft for a washing machine, the aluminum flange shaft comprises the die-castable aluminum alloy according to any one of claim 1 or claims 3 to 6.

* * * * *